US006652564B1

(12) United States Patent
Harris et al.

(10) Patent No.: US 6,652,564 B1
(45) Date of Patent: Nov. 25, 2003

(54) SPINAL THERAPY MACHINE

(76) Inventors: Robert D. Harris, P.O. Box 3309, Logan, UT (US) 84323; William R. Hachtmann, 1122 Maple St., Madera, CA (US) 93637

( * ) Notice: Subject to any disclaimer, the term of this patent is extended or adjusted under 35 U.S.C. 154(b) by 0 days.

(21) Appl. No.: 09/350,593

(22) Filed: Jul. 9, 1999

(51) Int. Cl.[7] ..... A61E 5/00
(52) U.S. Cl. ..... 606/237; 606/240; 602/32
(58) Field of Search ..... 5/636, 633, 640; 602/32, 36; 606/237, 240; 128/DIG. 20

(56) References Cited

U.S. PATENT DOCUMENTS 4,261,349 A * 4/1981 Lambson et al. ..... 128/89 R
4,890,344 A * 1/1990 Walker ..... 5/713
5,170,522 A * 12/1992 Walker ..... 5/615
5,201,102 A * 4/1993 McClure ..... 27/12
5,218,954 A * 6/1993 Van Bemmelen ..... 128/24 R
5,557,813 A * 9/1996 Steed et al. ..... 5/739
5,713,841 A * 2/1998 Graham ..... 602/32
5,722,923 A * 3/1998 Lui ..... 482/140

* cited by examiner

*Primary Examiner*—Danton D. DeMille
*Assistant Examiner*—Tam Nguyen
(74) *Attorney, Agent, or Firm*—Thompson E. Fehr

(57) ABSTRACT

A spinal therapy machine having an inflatable bladder. A rigid restraint running around the bladder causes the inflation to rise rather than to expand outward. Rings connected to the ends of the bladder are slidably attached to one or more posts that extend generally perpendicular to whatever structure upon which the bladder is placed. Either a control unit operated directly by the user or a computer direct the inflation of the bladder and, consequently, the elevation of a pad removably attached to the top of the bladder. Inflation is provided by a vacuum motor preferably connect to the bladder with a large tube in order to enable rapid changes in the degree of inflation.

20 Claims, 3 Drawing Sheets

SPINAL THERAPY MACHINE

BACKGROUND OF THE INVENTION

1. Field of the Invention

This invention relates to a device for exerting a lifting force upon the spine or chest of a user in order to increase and decrease the lordosis of the spine as a means of therapy.

2. Description of the Related Art

Three basic categories of machines have been patented for exerting force upon the spine of a patient. These consist of chiropractic tables wherein a central portion is mechanically raised and lowered (See, e.g., U.S. Pat. No. 3,998,218, which employs a stationary tubular jack housing having a smaller tube mounted inside and pushed upward by a screw member to raise the central portion of the chiropractic table, and U.S. Pat. No. 5,133,741, which utilizes a drive mechanism that is preferably a hydraulically driven piston to elevate the central portion of the chiropractic table.); tables where both extremities can be raised and lowered mechanically (See, e.g., U.S. Pat. No. 5,500,002, which utilizes cams and push rods to raise the extremities while a central portion of the table remains stationary, and U.S. Pat. No. 5,282,835, which employs linear actuators to extend or retract telescopic tubes to raise the first and second ends of a table which has no central portion.); and inflatable bladders that raise and lower cushions.

The simplest of the devices employing an inflatable bladder is the subject of U.S. Pat. No. 3,974,827. A bladder is placed upon a support and covered by a flexible, compressible layer such as foam rubber; the bladder has an air inlet/outlet and is inflated manually. The air inlet/outlet is disclosed to have "an inside diameter of about one-fourth of an inch," which would not facilitate rapid inflation and deflation. This is, however, logical in view of the fact that the disclosed operation of the device does not involve any cycling, only inflation to a desired extent.

Similarly, the device of U.S. Pat. No. 5,279,310 consists of a head rest, a lumbar rest, and a bottom rest, each of the rests having two inflation chambers that, in an unspecified manner, are "adjusted to adapt to the curve of the spine of the user."

U.S. Pat. No. 5,713,841 involves two inflatable bladders. Each bladder is mounted onto a support of a surrounding frame that resembles the structure of an external-frame backpack. One bladder is intended to extend against the cervical spine of a user; the other bladder, against the lumbar spine. The head of a user is strapped onto the frame; and the bladders are inflated with a manual air pump, an electrical air pump, or a blower. Each bladder, according to lines 13 through 16 of column 5 and lines 24 through 26 of column 7, is preferably so shaped (or preferably placed in a casing so shaped, according to lines 30 through 44 of column 5) that expansion upon inflation will be slightly greater toward the user than in a transverse direction. It appears, from lines 10 through 22 of column 6, that each bladder is inflated to a desired degree, depending upon the tolerance of the user, and subsequently completely deflated. There is no discussion of partial deflation. Nor is there an explanation of the rate of deflation. And inflation, according to line 10 of column 6, occurs "slowly."

U.S. Pat. No. 5,382,226 is a parent of No. 5,713,841 and dealt only with the portion of the device associated with use on the cervical spine.

As with U.S. Pat. No. 3,974,827, the device of U.S. Pat. No. 4,981,131 could be used by one who is supine; but, although stating that the device could be used "while seated or supine," U.S. Pat. No. 4,981,131 only explicitly discloses use in the seated position. Lines 53 through 59 in column 2 of U.S. Pat. No. 4,981,131 explain that the invention consists of " . . . a fluid-inflatable bag, a source of fluid under pressure, a conduit adapted to conduct the fluid between the source and the bag, and a regulator adapted for controlling the flow of the fluid in the conduit and the pressure in the bag." Air is provided by an electrically powered air pump. The air bag can collapse until it is fully deflated or until the time for the deflation interval has elapsed. Lines 18 through 30 of column 7 indicate that the user can select the input flow rate for air, the inflation interval, and the deflation interval. But, according to lines 10 through 11 of column 4, "The apparatus . . . runs automatically once the desired settings are made . . . " When the user is in a supine position, the support afforded to the user by the air bag is, however, unfortunately unstable.

A manually inflatable bladder that may be attached to a bench (with an "adhesive, a . . . belt, . . . snap-fasteners, or mating elements of hook and loop fabric fastener material such as sold under the Registered Trademark VELCRO") to support the spine of a supine weightlifter is the subject of U.S. Pat. No. 5,304,109. Optionally, the bladder can be mounted on a carriage that moves longitudinally along the bench.

SUMMARY OF THE INVENTION

The Spinal Therapy Machine constituting the present invention utilizes a bladder to create the desired lardosis in the spine of the user but, by encircling the bladder with a rigid restraint that is slidably attached to two posts extending generally perpendicular to the structure upon which the bladder is mounted, both directs that the expansion of the bladder will be directed upward from the surface on which the bladder has been placed and stabilizes the bladder.

A vacuum motor is utilized to inflate the bladder. The motor operates continuously to maintain the inflation of the bladder. The blade or blades of this vacuum motor spin faster when a greater voltage is applied to the motor. The faster the blade or blades are spinning, the greater the air pressure required to cause the blades to stall. Therefore, the greater the voltage that is applied to the motor, the higher the bladder will rise.

The vacuum motor facilitates rapid inflation and deflation of the bladder as also does the use of a large-diameter tube between the vacuum motor and the bladder. Since air can travel to or from the bladder through the tube and the vacuum motor, no exhaust port is needed to supplement an input port in the bladder. And because the vacuum motor spins incrementally faster with an incremental increase in voltage, the rate of spin is continuously variable. With an appropriate control unit, this variation in rate of spin and, consequently, the degree of inflation and height for the bladder is subject to essentially an infinite number of almost instantaneous adjustments.

And the control that is provided permits the user, himself or herself, to adjust the degree of inflation while utilizing the Spinal Therapy Machine. Alternately, the desired inflation and deflation can be programmed into a computer.

Finally, different cushions can be removably attached to the bladder to enable the Spinal Therapy Machine to be used for different techniques, such as having the user in either a prone or a supine position.

DESCRIPTION OF THE PREFERRED EMBODIMENT

Figure 1:
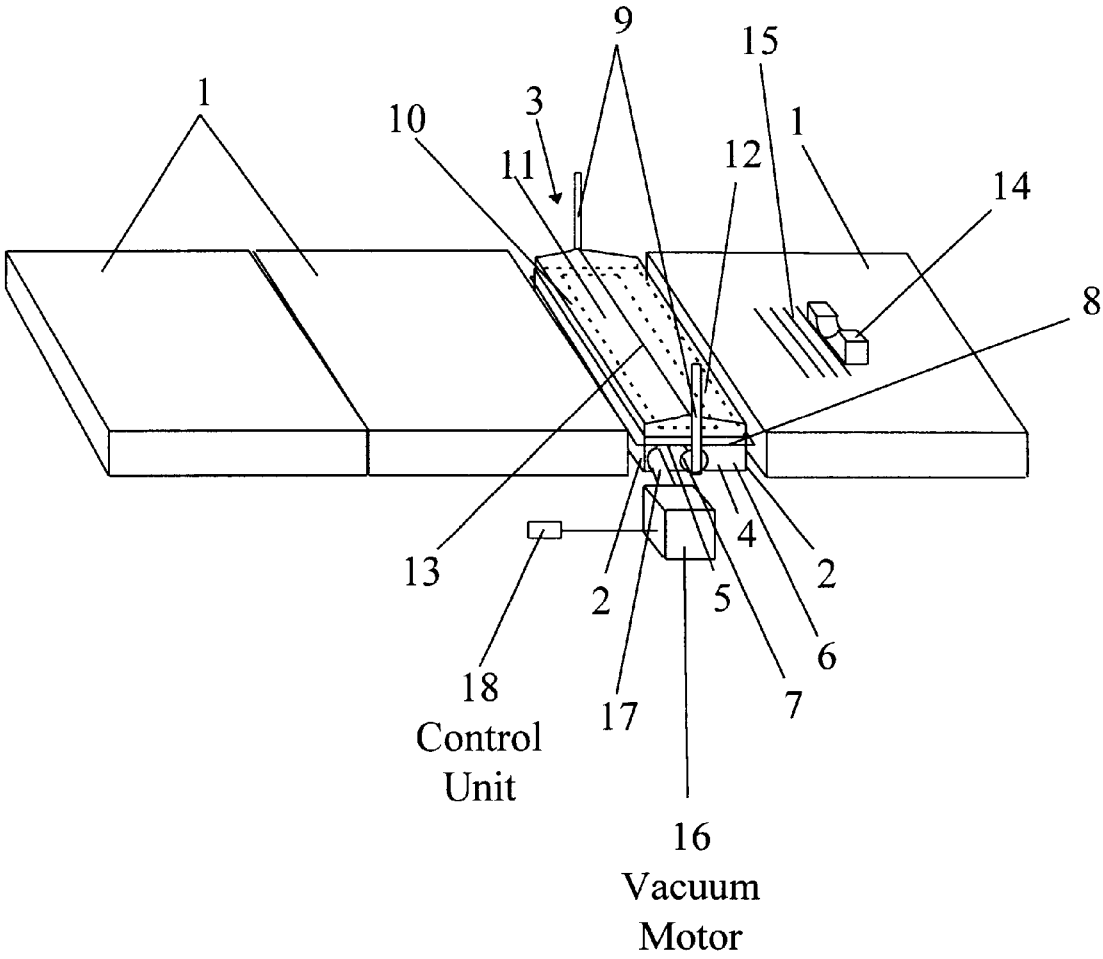
FIG. 1 illustrates the Spinal Therapy Machine with a control that is operated directly by the user.
Figure 2:
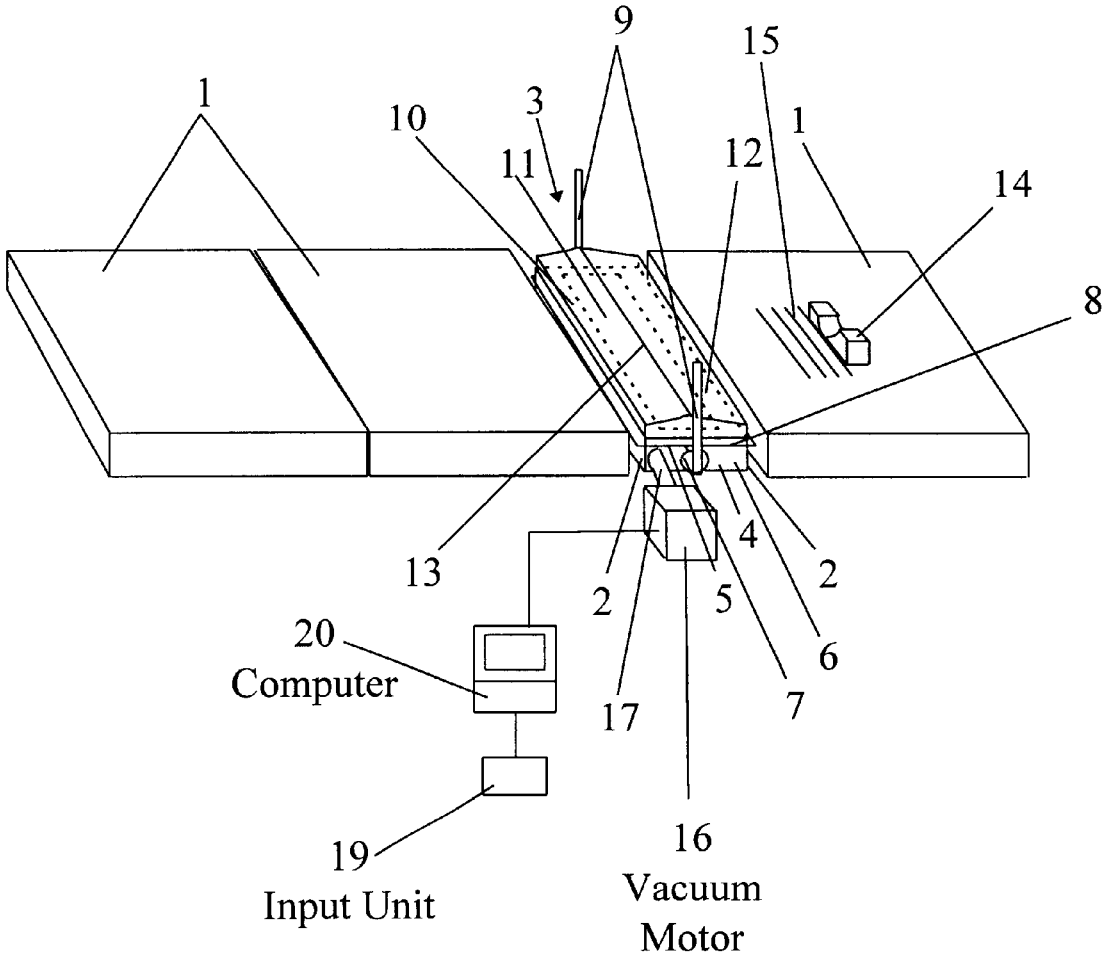
FIG. 2 depicts the Spinal Therapy Machine being controlled by a computer.
Figure 3:
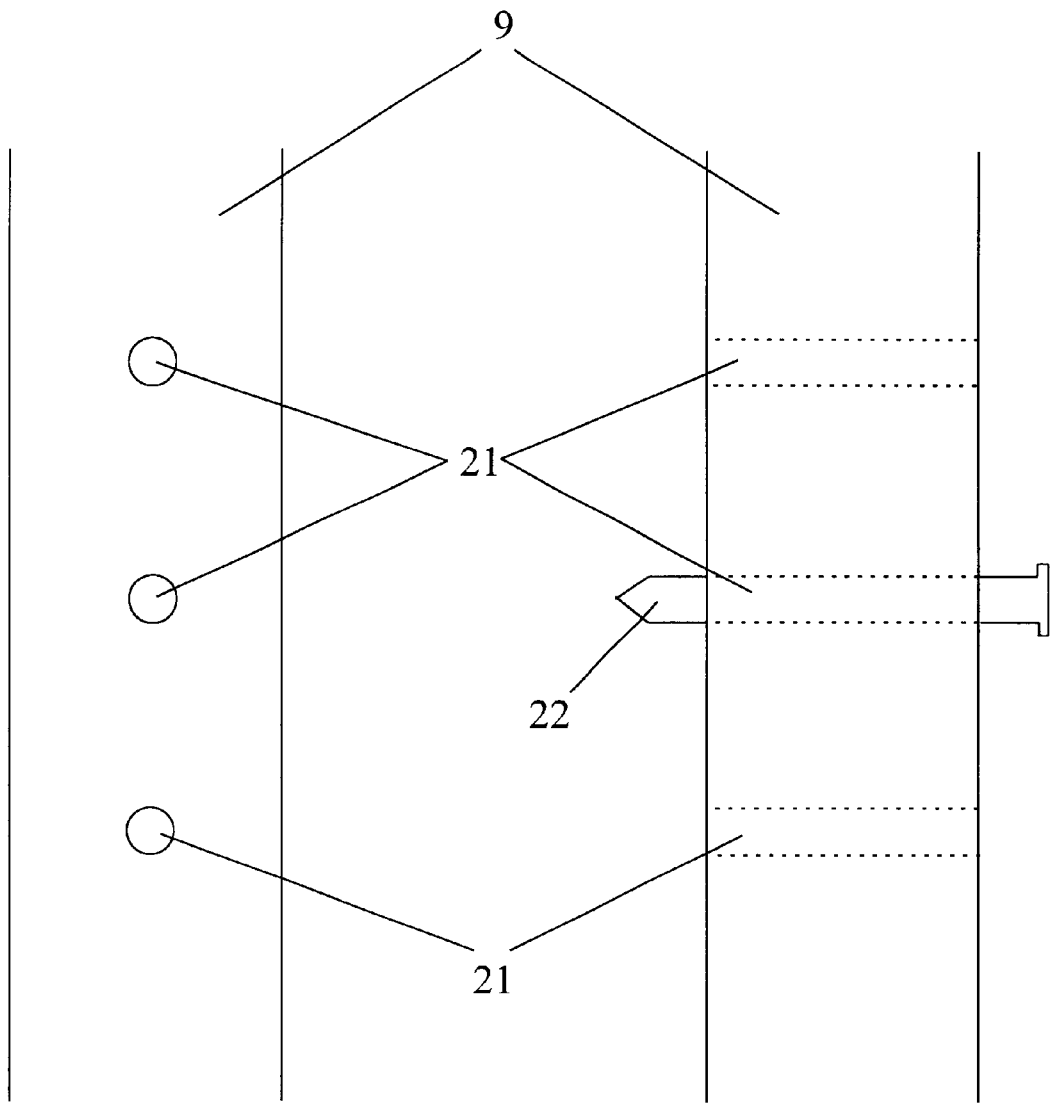
FIG. 3 shows apertures in the post that stabilizes the Spinal Therapy Machine and a pin that can be inserted into one of such apertures mechanically to limit the height to which the bladder of the Spinal Therapy Machine can be extended.

The Spinal Therapy Machine preferably has one or more cushions 1 on each side 2 of a lift mechanism 3, although it can function satisfactorily without the cushions 1.

The lift mechanism 3 can be any device which can be controlled smoothly to lift and lower a human body. Preferably, the lift mechanism 3 is an inflatable bladder 4 having a rigid restraint 5, such as one made from steel, running laterally and continuously around the sides 2 and ends 6 of the bladder 4 so that inflation causes such bladder 4 to rise rather than to spread outward from its sides 2 and ends 6. Preferably, the bladder 4 is operated with such low pressure air that a pressure regulator is unnecessary. Also, to maintain the bladder 4 in its desired position, i.e., to provide stability for the bladder 4, the restraint 5 is preferably slidably attached, preferably by a ring 7 connected to the restraint 5 preferably at each end 8 of the restraint 5, to a post 9 extending generally perpendicular to whatever structure upon which the bladder 4 is located.

Attached to the top 10 of the lift mechanism 3 is a plate 11. The plate 11 can be constructed of any material which has the requisite strength to support a human body, e.g., stainless steel or an appropriate plastic.

To the plate 11 can be removably attached, e.g., with VELCRO®, a pad 12. The pad 12 will have various versions, viz., one to support the upper back when the user of the Spinal Therapy Machine is in a supine position, one to support the lower back when the user of the Spinal Therapy Machine is in a supine position, and one to support the chest when the user of the Spinal Therapy Machine is in a prone position.

The versions of the pad 12 to be used with the upper back and the lower back are preferably shaped to have force distributed along an apex 13 of the pad 12.

Also, when the user is to be in a supine position, a neck rest 14 can be removably attached, e.g., with VELCRO®, to the cushion 1 above which the head of the user will be located. Visual markings 15 are preferably located on the cushion 1 to facilitate placement of the cushion 1 for individuals of different heights.

A vacuum motor 16 is preferably utilized to inflate the bladder 4. As explained above, the motor 16 operates continuously to maintain the inflation of the bladder 4. The blade or blades of this vacuum motor spin faster when a greater voltage is applied to the motor 16. The faster the blade or blades are spinning, the greater the air pressure required to cause the blades to stall. Therefore, the greater the voltage that is applied to the motor 16, the higher the bladder 4 will rise.

The vacuum motor 16 facilitates rapid inflation and deflation of the bladder 4, when such rapidity is desired, as also does the use of a large-diameter tube 17 to connect the vacuum motor 16 to the bladder 4. Since air can travel to or from the bladder 4 through the tube 17 and the vacuum motor 16, no exhaust port is needed to supplement an input port in the bladder. And because the vacuum motor 16 spins incrementally faster with an incremental increase in voltage, the rate of spin is continuously variable. With an appropriate control unit 18, this variation in rate of spin and, consequently, the degree of inflation and height for the bladder 4 is subject to essentially an infinite number of almost instantaneous adjustments.

Preferably, the user utilizes any control unit 18 that is well known in the art to supply the requisite voltage to the vacuum motor 16 to raise and lower the pad 12 when and to whatever degree the user desires. Alternatively, the user can select the height which the pad 12 is lifted and lowered, the number of lifting and lowering cycles, and the rate of cycling by entering such information into any input unit 19 that is well known in the art for communicating desired actions to a computer 20; the selected process is then implemented by the computer 20.

The user can, for example, extend the bladder 4 to obtain the desired degree of lardosis and then extend the bladder 4 slightly higher, lower the bladder 4 to the height which provided the initial desired degree of lardosis, and then repeat this process as many times as desired or as specified by a medical care provider.

Optionally, at least one post 9 contains one or more apertures 21 into which a pin 22 can be inserted to preclude the ring 7 from rising beyond such aperture 21 no matter how much voltage is applied to the vacuum motor 16.

We claim:

1. A spinal therapy machine which comprises:

an inflatable bladder;

a means for inflating said inflatable bladder connected to said inflatable bladder;

a means for controlling the inflation of said inflatable bladder; and a rigid restraint running laterally and continuously around the sides and ends of said bladder, a post, and a ring connected to an end of the restraint and slidably attached to said post.

2. The spinal therapy machine as recited in claim 1, wherein:

the means for inflating said inflatable bladder is a vacuum motor.

3. The spinal therapy machine as recited in claim 2, further comprising:

a plate attached to the top of said inflatable bladder; and a pad removably attached to said plate.

4. The spinal therapy machine as recited in claim 3, wherein:

a large-diameter tube connects said vacuum motor to said inflatable bladder.

5. The spinal therapy machine as recited in claim 2, wherein:

a large-diameter tube connects said vacuum motor to said inflatable bladder.

6. The spinal therapy machine as recited in claim 1, further comprising:

a plate attached to the top of said inflatable bladder; and a pad removably attached to said plate.

7. The spinal therapy machine as recited in claim 6, wherein:

a large-diameter tube connects said means for inflating said inflatable bladder to said inflatable bladder.

8. The spinal therapy machine as recited in claim 1, wherein:

a large-diameter tube connects said means for inflating said inflatable bladder to said inflatable bladder.

9. The spinal therapy machine as recited in claim 1, further comprising:

a plate attached to the top of said inflatable bladder; and a pad removably attached to said plate, wherein the means for inflating said inflatable bladder is a vacuum motor.

10. The spinal therapy machine as recited in claim 9, wherein:

a large-diameter tube connects said vacuum motor to said inflatable bladder.

11. A spinal therapy machine, which comprises:

an inflatable bladder;

a means for inflating said inflatable bladder connected to said inflatable bladder;

a means for controlling the inflation of said inflatable bladder;

a means for stabilizing said inflatable bladder;

a plate attached to the top of said inflatable bladder; and a pad removably attached to said plate.

12. The spinal therapy machine as recited in claim 11, wherein:

a large-diameter tube connects said means for inflating said inflatable bladder to said inflatable bladder.

13. A spinal therapy machine, which comprises:

an inflatable bladder;

a vacuum motor connected to said inflatable bladder;

a control unit for a user to utilize for controlling the inflation of said inflatable bladder;

a rigid restraint running laterally and continuously around the sides and ends of said bladder;

a post; and a ring connected to an end of the restraint and slidably attached to said post.

14. The spinal therapy machine as recited in claim 13, further comprising:

a plate attached to the top of said inflatable bladder; and a pad removably attached to said plate.

15. The spinal therapy machine as recited in claim 14, wherein:

a large-diameter tube connects said vacuum motor to said inflatable bladder.

16. The spinal therapy machine as recited in claim 13, wherein:

a large-diameter tube connects said vacuum motor to said inflatable bladder.

17. A spinal therapy machine, which comprises:

an inflatable bladder;

a vacuum motor connected to said inflatable bladder;

a computer for controlling the inflation of said inflatable bladder;

an input unit communicating with said computer;

a rigid restraint running laterally and continuously around the sides and ends of said bladder;

a post; and a ring connected to an end of the restraint and slidably attached to said post.

18. The spinal therapy machine as recited in claim 17, further comprising:

a plate attached to the top of said inflatable bladder; and a pad removably attached to said plate.

19. The spinal therapy machine as recited in claim 18, wherein:

a large-diameter tube connects said vacuum motor to said inflatable bladder.

20. The spinal therapy machine as recited in claim 17, wherein:

a large-diameter tube connects said vacuum motor to said inflatable bladder.

* * * * *